US010953669B1

(12) United States Patent
Sivaraman et al.

(10) Patent No.: US 10,953,669 B1
(45) Date of Patent: Mar. 23, 2021

(54) PAPER JAM CLEARANCE MECHANISM

(71) Applicant: XEROX CORPORATION, Norwalk, CT (US)

(72) Inventors: Senthil Sivaraman, Webster, NY (US); Ramesh Karuppasamy, Chennai (IN); Sivakumar Mani, Chennai (IN)

(73) Assignee: Xerox Corporation, Norwalk, CT (US)

( * ) Notice: Subject to any disclaimer, the term of this patent is extended or adjusted under 35 U.S.C. 154(b) by 16 days.

(21) Appl. No.: 16/582,175

(22) Filed: Sep. 25, 2019

(51) Int. Cl.
*B41J 11/00* (2006.01)

(52) U.S. Cl.
CPC ..... *B41J 11/006* (2013.01)

(58) Field of Classification Search
CPC ..... B41J 11/006; B41J 11/0095
USPC ..... 347/101, 104
See application file for complete search history.

(56) References Cited

U.S. PATENT DOCUMENTS 7,992,864 B2 * 8/2011 Shirasaki ..... G03G 15/6544 271/189
8,662,618 B2 * 3/2014 Okamoto ..... B41J 11/006 347/16
9,592,975 B2 * 3/2017 Ishikawa ..... B65H 5/26
2012/0027428 A1 * 2/2012 Terao ..... B65H 45/18 399/21

* cited by examiner

*Primary Examiner* — An H Do

(57) ABSTRACT

Examples of a paper-clearance apparatus for removing jammed paper from a printer are described herein. The paper-clearance apparatus includes an outer shaft mounted transversely above a printing medium path of a printer; an inner shaft movably disposed inside the outer shaft; a roller assembly including a sliding bush mounted over the outer shaft; and a handle connected inside the inner shaft from outside a printer housing. The handle is being rotatable so that the roller connected with the inner shaft touches the jammed paper and rotates along with the jammed paper to grip the jammed paper. Further, the handle is being pullable away from the printer housing so as to pull out the jammed paper beneath the printer housing.

28 Claims, 15 Drawing Sheets

PAPER JAM CLEARANCE MECHANISM

TECHNICAL FIELD

The present disclosure, in general, relates to printers and, more particularly, to a paper jam clearance mechanism for the printers.

BACKGROUND

A multifunctional device employing a printing medium path is generally known as a "paper-feed" printer 100 (FIG. 1A). In the known "paper-feed" printer 100, sheets of paper or other printing media are pulled or picked from an input tray and fed downstream into the print engine components where the desired image is formed on each paper sheet. This operation is typically accomplished using a series of motor-driven rollers that have frictionally adherent surfaces. The surface of the initial or pick roller rotates against the upper surface of the top sheet in the stack to direct the top sheet along a predetermined printing medium path 102. The paper sheet is advanced through an infeed zone and is received by a drive roller which supplies the sheet into a processing zone for printing. The paper sheet is then expelled through an output zone towards an output tray. This cycle is repeated for each paper sheet to be printed.

A problem experienced with printers of such type is that the paper sheet being fed may become subject to a disturbance somewhere along the printing medium path 102. The disturbance is typically the result of a paper sheet having imperfections, a paper sheet of a size smaller than the intended size, or becoming skewed in the infeed or output zones. Usually, the paper sheet encountering the disturbance will be blocked. Consequently, the paper sheet will become "jammed" in the "paper-feed" printer 100. This effect is known as a sheet or paper jam. Sheet or paper jams can also occur in the other types of printers referred to above which employ printing medium paths.

Although the frequency of paper jams in modern printers has generally decreased, when this problem does occur the result can have a damaging effect on the printer. For instance, a printer motor can over-heat as a result of the increased load on the rollers during paper jams. Also, in printers using ink, the image forming components may deposit ink within the printer instead of on the paper sheet In order to reduce the damaging effects of paper jams, printers have been developed which can detect certain indicators of a paper jam so that the operations of the printer are ceased as soon as possible.

Once a paper jam has occurred, the jammed paper will often end up concertinaed in some form next to the drive roller. Removal of the paper to clear the jam may then be performed manually by grabbing one of the ends of the paper and pulling. However, this method is undesirable since the paper may rip or unnecessary strain may be placed on the motor as the drive roller is forced around too quickly.

A more suitable and commonly used method of removing a jammed sheet of paper is to manually rotate the drive roller to direct the paper along the printing medium path 102 (FIGS. 1B and 1C). This manual rotation may be enabled by a knob located outside a printer housing which is attached to the drive roller. The drive roller may be rotated either in a forward direction to direct the jammed sheet towards the output zone or in a reverse direction to direct the jammed sheet towards the infeed zone. The choice of direction is arbitrary and both directions are generally attempted, on the basis of trial and error, until the successful release of the jammed paper into one of the infeed or output zones. Accordingly, there is a need for having a mechanism which can allow a user to clear the jammed paper from the printing medium path with precision.

SUMMARY

According to aspects illustrated herein, the present disclosure relates to a paper-clearance apparatus for removing jammed paper from a printer. The paper-clearance apparatus includes an outer shaft mounted transversely above a printing medium path of a printer; an inner shaft movably disposed inside the outer shaft; a roller assembly including a sliding bush mounted over the outer shaft; and a handle connected inside the inner shaft from outside a printer housing. The handle is being rotatable so that the roller connected with the inner shaft touches the jammed paper and rotates along with the jammed paper to grip the jammed paper. Further, the handle is being pullable away from the printer housing so as to pull out the jammed paper beneath the printer housing.

According to further aspects illustrated herein, the present disclosure relates to a printer. The printer includes two parallel external brackets of a printer housing and an outer shaft mounted between the two parallel external brackets and mounted transversely above a printing medium path of the printer; an inner shaft movably disposed inside the outer shaft; a roller assembly including a sliding bush mounted over the outer shaft; and a handle connected inside the inner shaft from outside a printer housing. The handle is being rotatable so that the roller connected with the inner shaft touches the jammed paper and rotates along with the jammed paper to grip the jammed paper. Further, the handle is being pullable away from the printer housing so as to pull out the jammed paper beneath the printer housing.

Other and further aspects and features of the disclosure will be evident from reading the following detailed description of the embodiments, which are intended to illustrate, not limit, the present disclosure.

BRIEF DESCRIPTION OF DRAWINGS

The illustrated embodiments of the subject matter will be best understood by reference to the drawings, wherein like parts are designated by like numerals throughout. The following description is intended only by way of example, and simply illustrates certain selected embodiments of devices, systems, and processes that are consistent with the subject matter as claimed herein.

DETAILED DESCRIPTION

A few inventive aspects of the disclosed embodiments are explained in detail below with reference to the various figures. Embodiments are described to illustrate the disclosed subject matter, not to limit its scope, which is defined by the claims. Those of ordinary skill in the art will recognize a number of equivalent variations of the various features provided in the description that follows.

Non-Limiting Definitions

Definitions of one or more terms that will be used in this disclosure are described below without limitations. For a person skilled in the art, it is understood that the definitions are provided just for the sake of clarity and are intended to include more examples than just provided below.

The term "printer" refers to a device or a combination of multiple devices configured to perform printing. In context of the present disclosure, the printer includes paper jam clearance mechanism. The term printer is intended to include impact printers, laser printers, inkjet printers, copiers, fax machines, multi-function devices, multi-function peripheral devices and other relevant image forming machines employing printing medium paths.

The "media" refers to any paper or other media size/type required for printing.

The "user" may refers to an end user or an admin user who can operate the printer, specifically, the paper jam clearance mechanism.

Figure 1A:
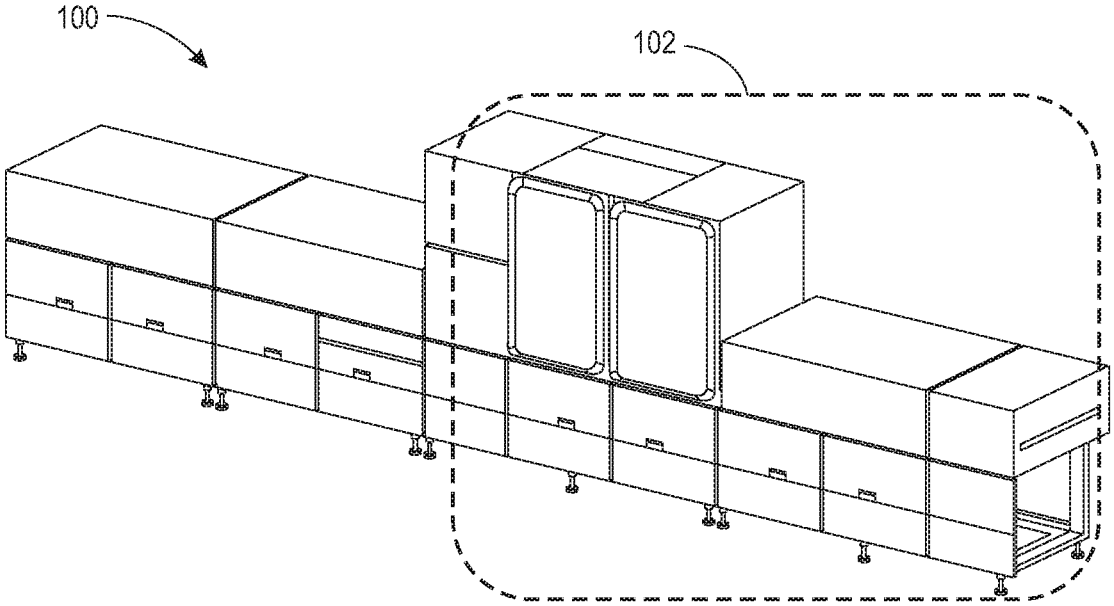
FIGS. 1A-1E illustrate various views of a conventional "paper-feed" printer.
Figure 1B:
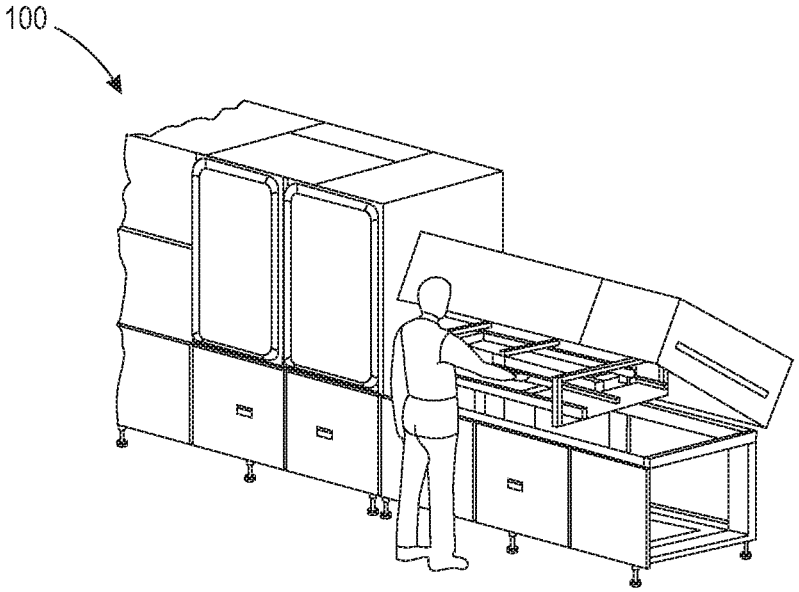
Figure 1C:
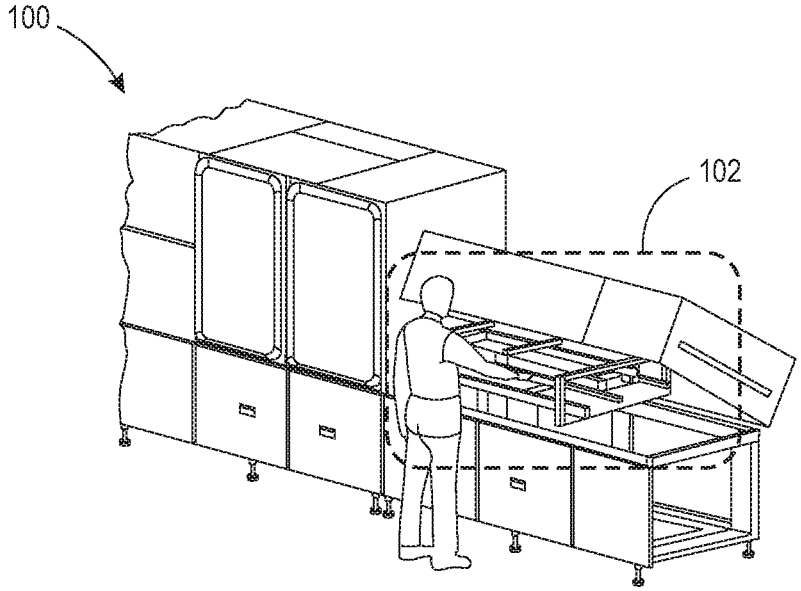
Figure 1D:
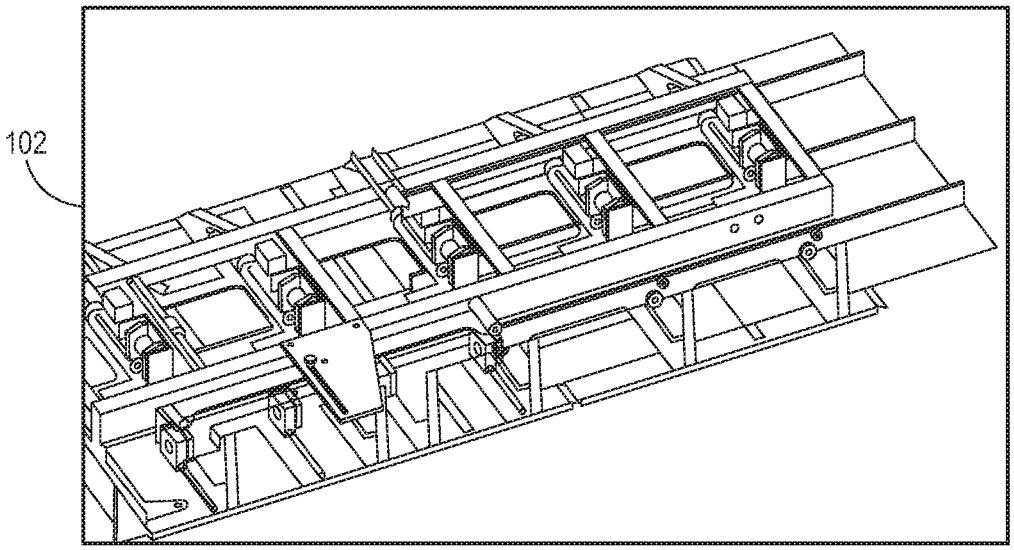
Figure 1E:
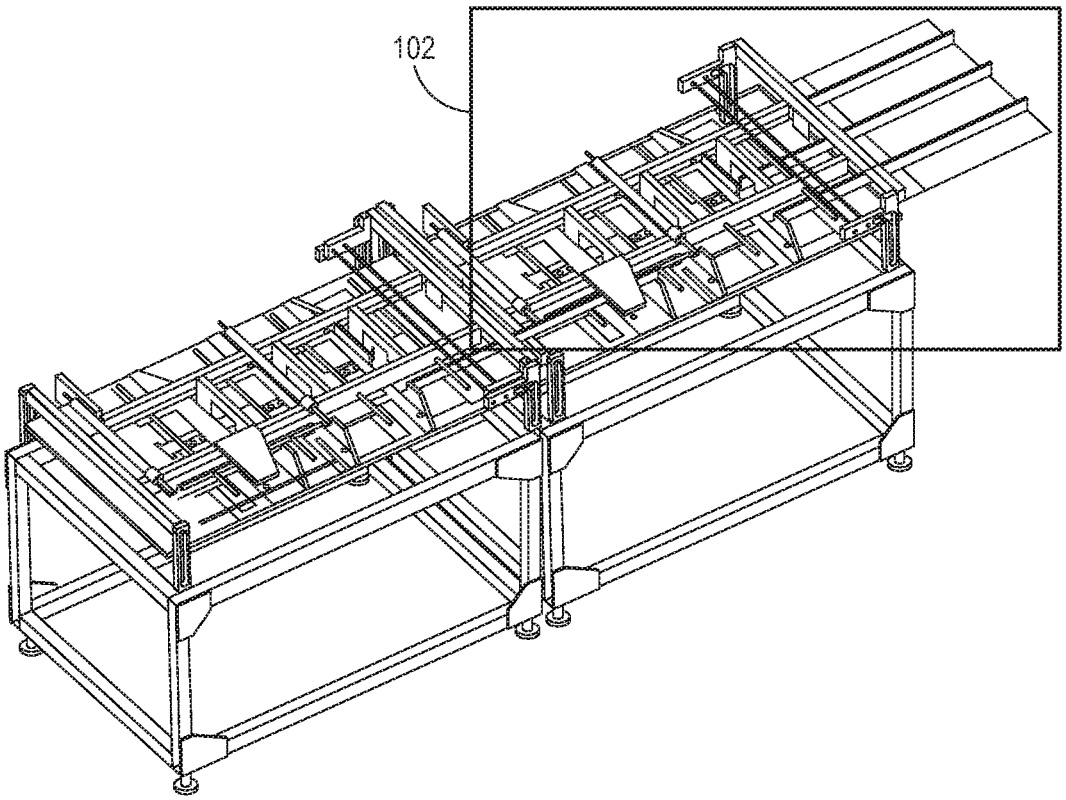

Typically when a paper is jammed in a printer such as wide format paper printers as shown in FIG. 1A, a user such as admin or an end user may lift print medium path (or an upper transport assembly) to remove the jammed paper and normal functioning of the printer can be resumed. It is still difficult to remove the jammed paper as access space is limited in the printer. Moreover, the user has to lean forward to grab the paper and there are chances that the user may fall into the printer and may get injured. In addition, the user may not have clear visibility of where the paper is jammed inside the printer. FIG. 1A shows a wide format paper printers having a transport assembly. While FIGS. 1B and 1C show a user operating the printer, specifically operating to remove the jammed paper according to existing solutions. FIGS. 1D and 1E show a paper inside the print medium path travelling from one place to another place.

The present disclosure discloses a paper jam clearance mechanism for printers providing an improved paper jam removing capability. The paper jam clearance jam assembly primarily incudes a handle, and a roller assembly. When a paper gets jammed in the printer i.e., in a transport assembly (print medium path), the handle is rotated such that the roller assembly is in touch with the paper. Once the paper is in touch with the roller assembly, the handle is pulled in an outward direction by the user to grip the paper along the roller assembly. In this manner, the paper travels outside the transport assembly. And The user can now accesses the paper from the outside of the printer and remove fully from the printer. As a result, the user does not require to open the printer and is not injured while removing the paper out of the printer.

In an aspect, the present disclosure relates to a paper-clearance apparatus for removing jammed paper from a printer. The paper-clearance apparatus includes an outer shaft mounted transversely above a printing medium path of a printer; an inner shaft movably disposed inside the outer shaft; a roller assembly including a sliding bush mounted over the outer shaft; and a handle connected inside the inner shaft from outside a printer housing. The handle is being rotatable so that the roller connected with the inner shaft touches the jammed paper and rotates along with the jammed paper to grip the jammed paper. Further, the handle is being pullable away from the printer housing so as to pull out the jammed paper beneath the printer housing.

In an aspect, the handle is rotatable in a first direction to grip and pull out the jammed paper. Further, in order to remove the jammed paper from the printer, the handle is to be pulled outside for about 10 mm before being rotated in the first direction. Also, the handle is rotatable in a second direction which is being opposite to the first direction, so as to unlock the inner shaft from the outer shaft.

In an aspect, the first direction of rotation can be clockwise direction while the second direction of rotation can be anticlockwise direction, or vice versa.

The disclosure can be implemented for any printers such as wide format paper printers without any limitation. The paper jam clearance mechanism can be easily installed in the printers, specially, printing medium path of the printer. The printer is one just example, but the present disclosure may include a multi-function device, a multi-function peripheral device or equivalent device with printing capabilities.

Figure 2A:
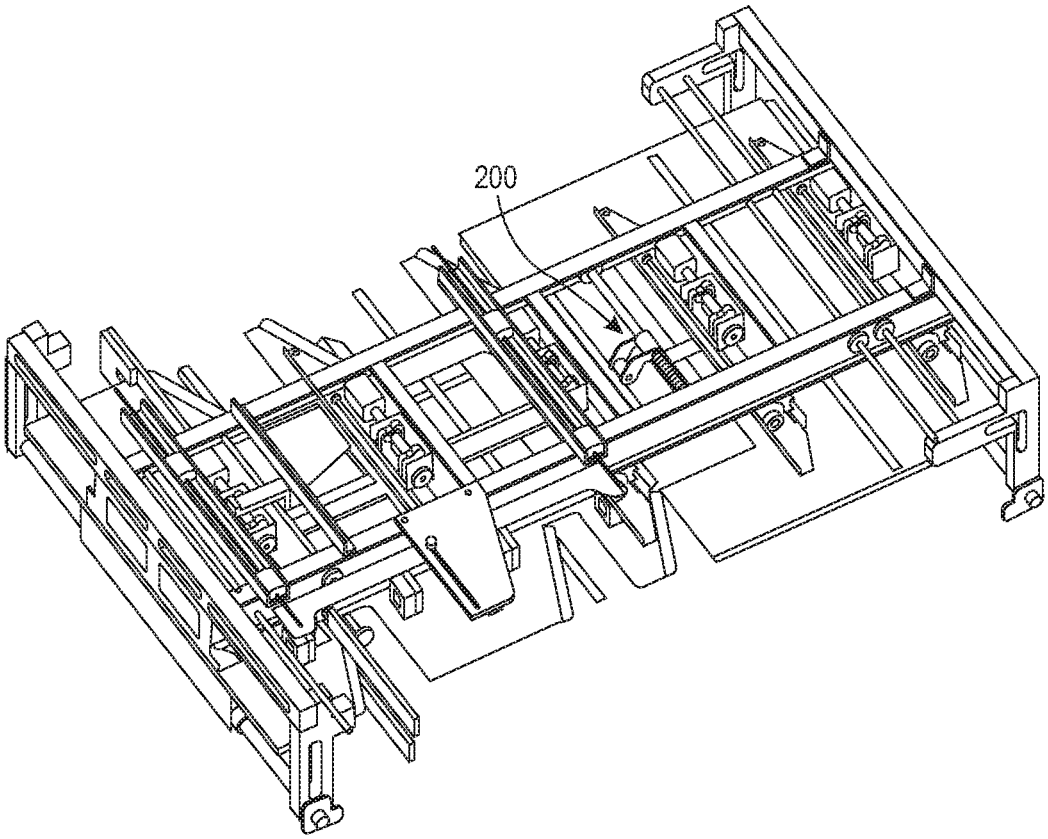
FIG. 2A illustrates a paper-clearance apparatus installed in a printing medium path, in accordance with an embodiment of the present disclosure.
Figure 2B:
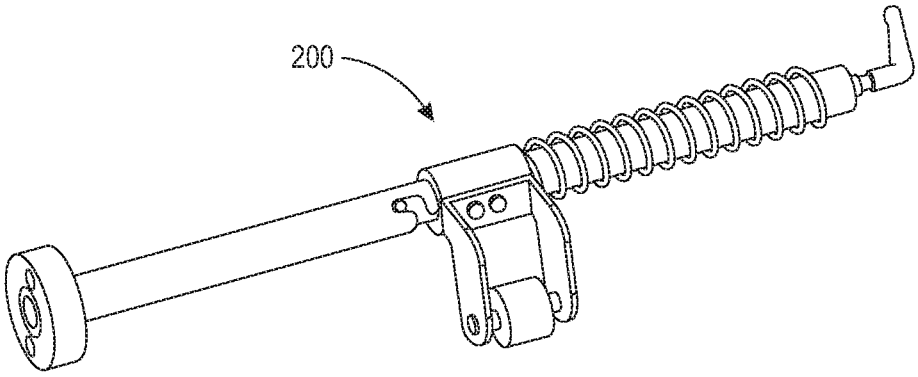
FIG. 2B illustrates an exemplary perspective view of the paper-clearance apparatus, in accordance with an embodiment of the present disclosure.

FIG. 2A illustrates a paper-clearance apparatus 200 installed in the printing medium path 102 for removing jammed paper, in accordance with an embodiment of the present disclosure. An exemplary perspective view of the paper-clearance apparatus 200 is shown in FIG. 2B.

Figure 2C:
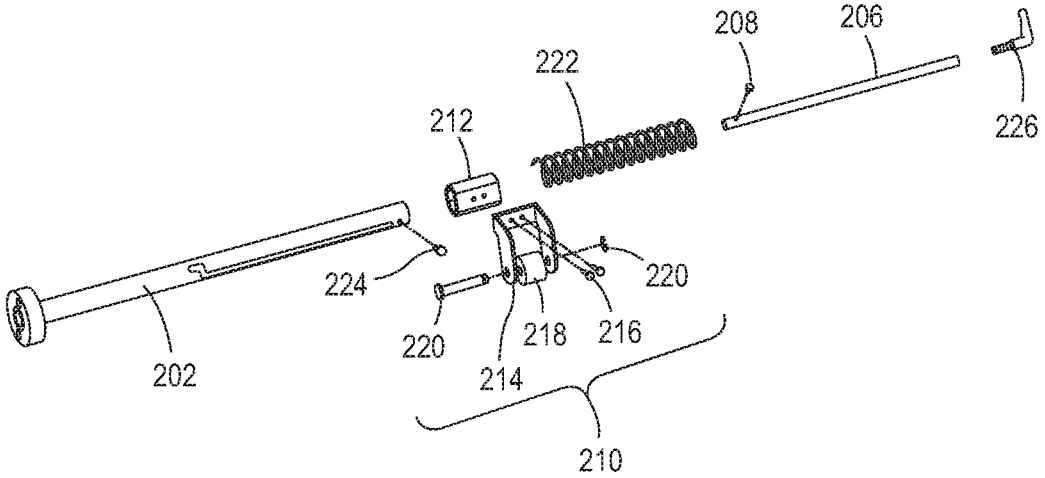
FIG. 2C illustrates an exploded view of the paper-clearance apparatus in accordance with an embodiment of the present disclosure.
Figure 2D:
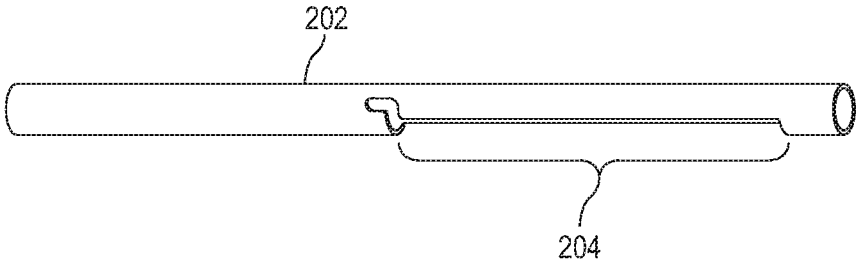
FIG. 2D illustrates an outer shaft of the paper-clearance apparatus in accordance with an embodiment of the present disclosure.

FIG. 2C illustrates an exploded view of the paper-clearance apparatus 200 in accordance with an embodiment of the present disclosure. The paper-clearance apparatus 200 includes an outer shaft 202 (FIG. 2D), the outer shaft 202 is mounted transversely above a printing medium path 102 of the printer. In an aspect, the length of the outer shaft 202 corresponds to the width of the printing medium path 102 of a printer. Further, the outer shaft 202 is formed with an open longitudinal guide path 204 as seen in FIG. 2D. In other words, the guide path 204 is a longitudinal cutout on the external surface of the outer shaft 202. The guide path 204 is formed from the center of the outer shaft 202 up to one of the external end of the outer shaft 202.

Figure 2E:
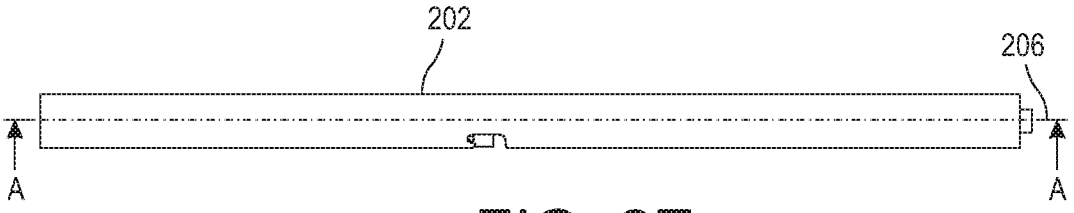
FIG. 2E illustrates an assembled state of an outer shaft and an inner shaft of the paper-clearance apparatus.
Figure 2F:
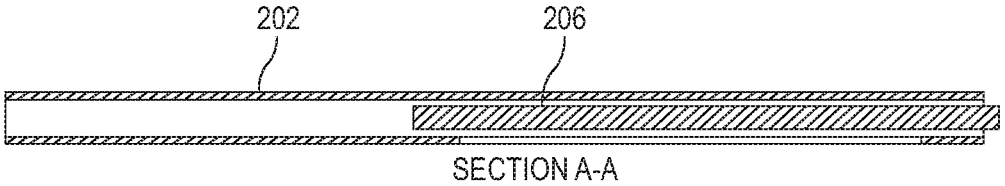
FIG. 2F illustrates a cross-section view of the assembly of the outer shaft and the inner shaft.

The paper-clearance apparatus 200 further includes an inner shaft 206. In an aspect, the inner shaft 206 has half the length of the outer shaft 202. The inner shaft 206 is assembled inside the outer shaft 202 and locked inside the guide path 204 using a guide pin 208. The guide pin 208 is fixed on the inner shaft 202 in such a way that it gets locked at the internal end of the guide path 204. FIG. 2E shows an assembled state of the outer shaft 202 and the inner shaft 206, while FIG. 2F shows a cross-section view of the assembly of the outer shaft 202 and the inner shaft 206.

Figure 2G:
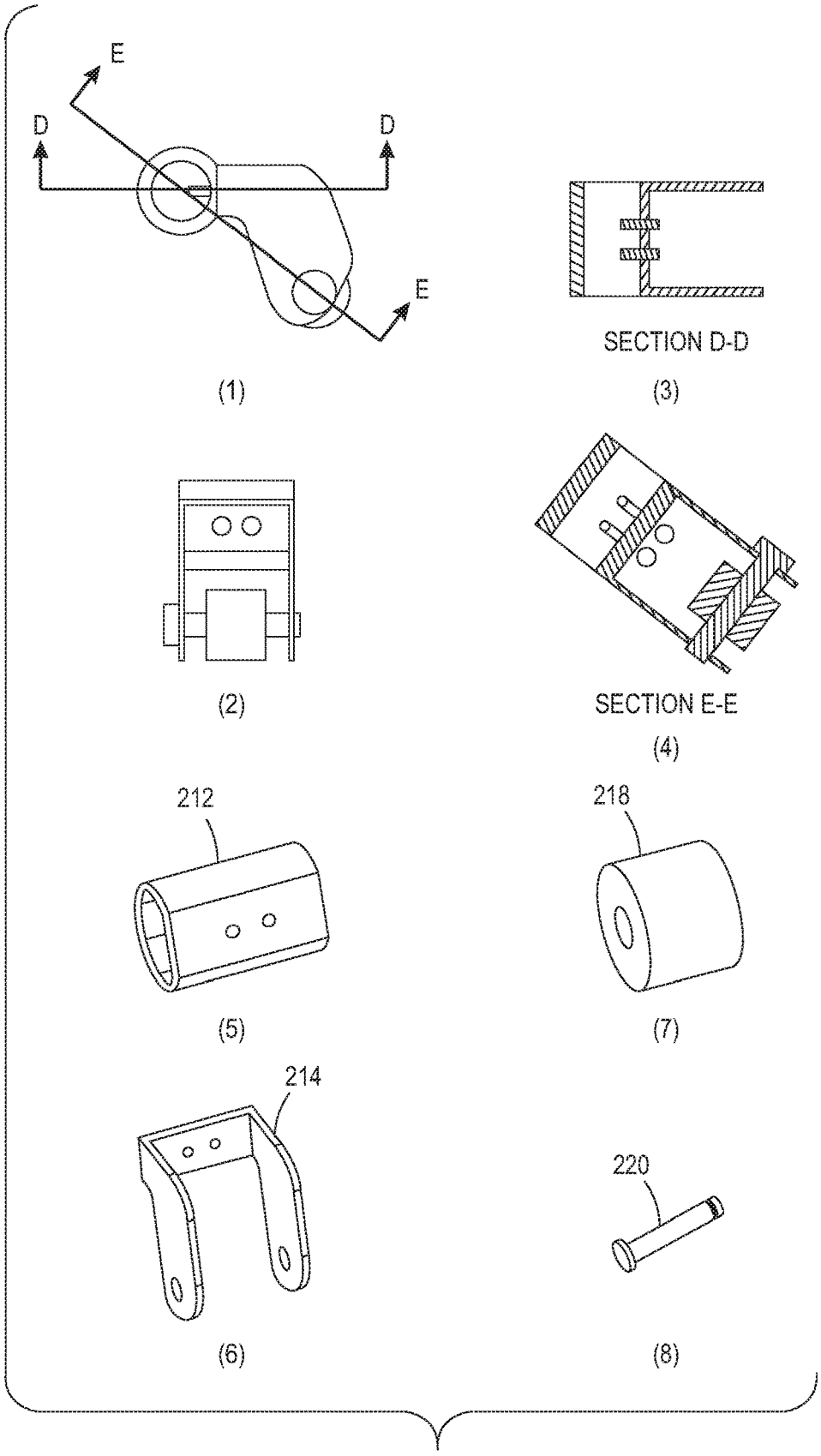
FIG. 2G shows various views of the roller assembly in accordance with an embodiment of the present disclosure.

The paper-clearance apparatus 200 further includes a roller assembly 210. FIG. 2G shows various views of the roller assembly 210. For instance, FIG. 2G(1) shows a side view of the roller assembly 210, FIG. 2G(2) shows a top view of the roller assembly, FIG. 2G(3) shows a section D-D cross-section view of the roller assembly 210, FIG. 2G(4) shows a section E-E cross-section view of the roller assembly 210. The roller assembly 210 includes a sliding bush 212 (FIG. 2G(5)) mounted over the outer shaft 202, a mounting bracket 214 (FIG. 2G(6)) locked at its flange-shaped head portion with the sliding bush 212 on an internal end of the inner shaft 206 using a pair of screws 216, and a roller 218 (FIG. 2G(7)) mounted in between L-shaped legs of the mounting bracket 214 using fasteners 220 (FIG. 2G(8)). In an example, the fasteners 220 can be a pin and clip assembly.

The paper-clearance apparatus 200 further includes a spring 222 arranged over the outer shaft 202 and in the region of the guide path 204. The spring 22 is arranged between the sliding bush 212 and a screw 224 fixed on the external end of the outer shaft 202.

The paper-clearance apparatus 200 further includes a handle 226 connected inside the external end of the inner shaft 206. The handle 226 is mounted outside the housing of the printer printer. The handle 226 is rotatable in a first direction such as clockwise to grip and pull out the jammed paper. The handle 226 is to be pulled outside for about 10 mm before being rotated in the first direction to remove the jammed paper from the printer. The handle is rotatable in a second direction such as anticlockwise which is being opposite to the first direction, so as to unlock the inner shaft 206 from the outer shaft 202.

Figure 2H:
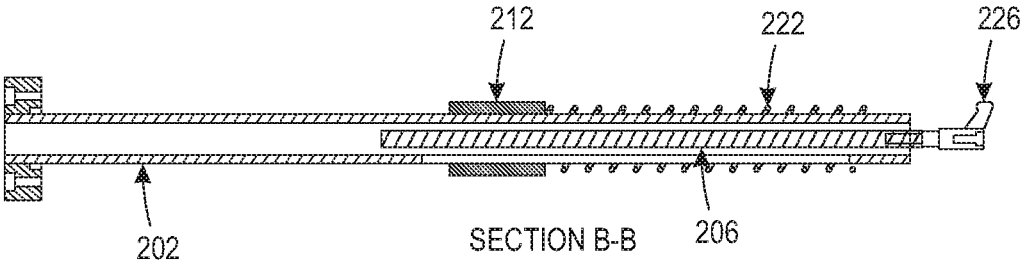
FIGS. 2H, 2I, and 2J illustrate multiple views of the assembled paper-clearance apparatus in accordance with an embodiment of the present disclosure.
Figure 2I:
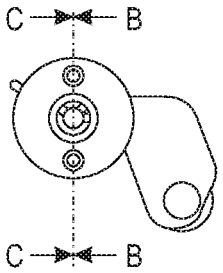
Figure 2J:
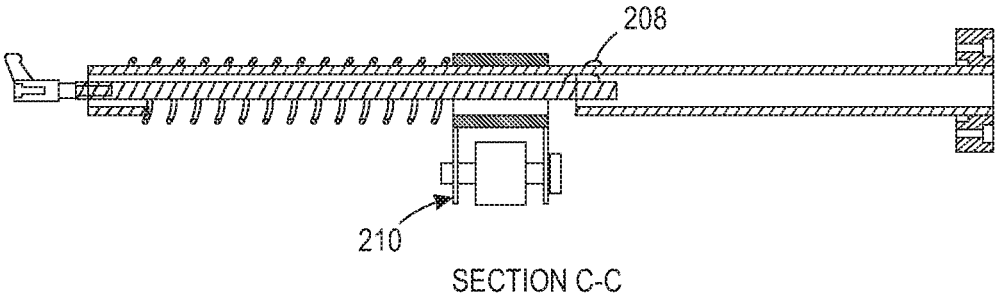

FIGS. 2H, 2I, and 2J illustrate multiple views of the assembled paper-clearance apparatus 200 in accordance with the present disclosure.

Figure 3A:
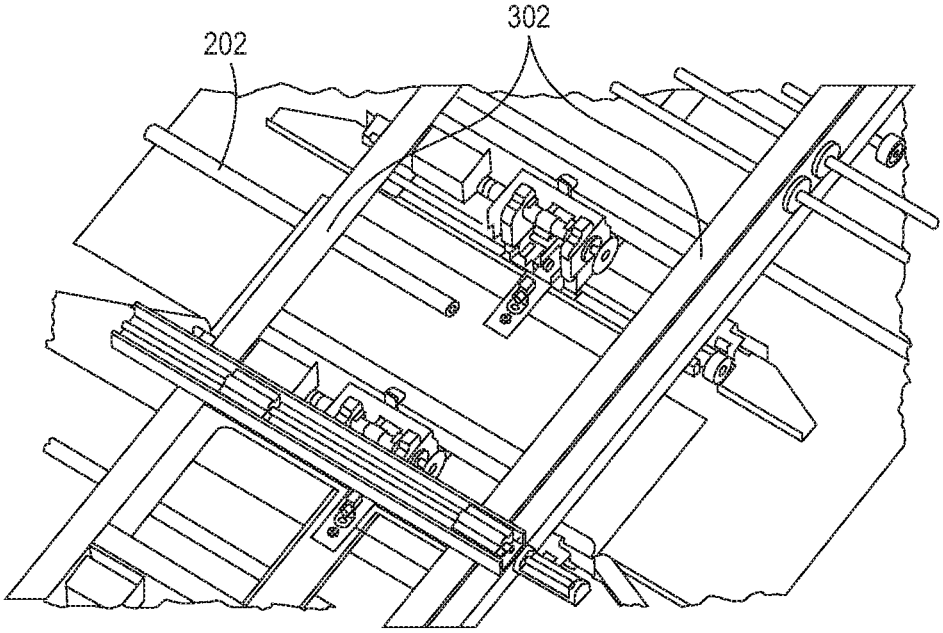
FIGS. 3A-3D illustrate various exemplary views of steps involved in assembly of the paper-clearance apparatus in the printing medium path, in accordance with an embodiment of the present disclosure.
Figure 3B:
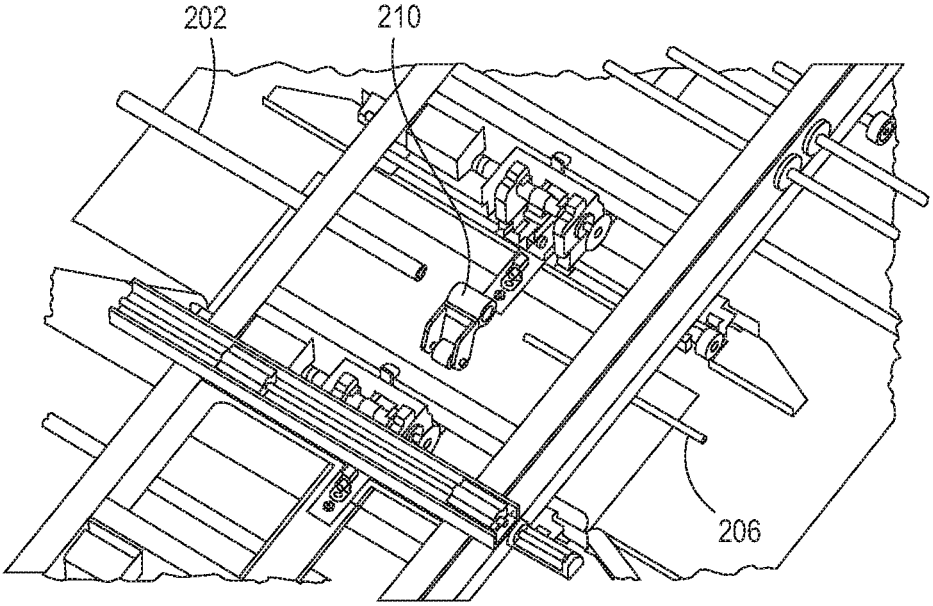
Figure 3C:
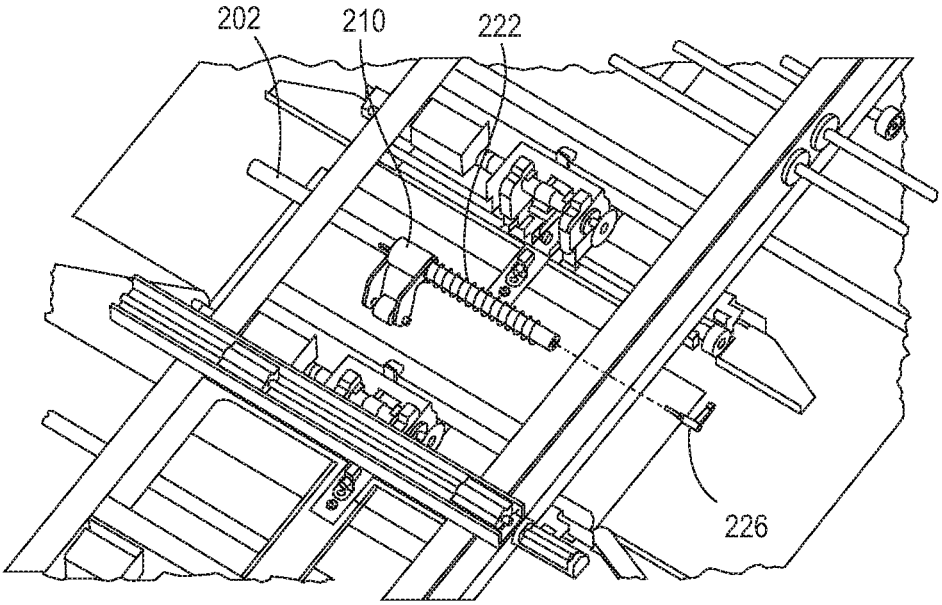
Figure 3D:
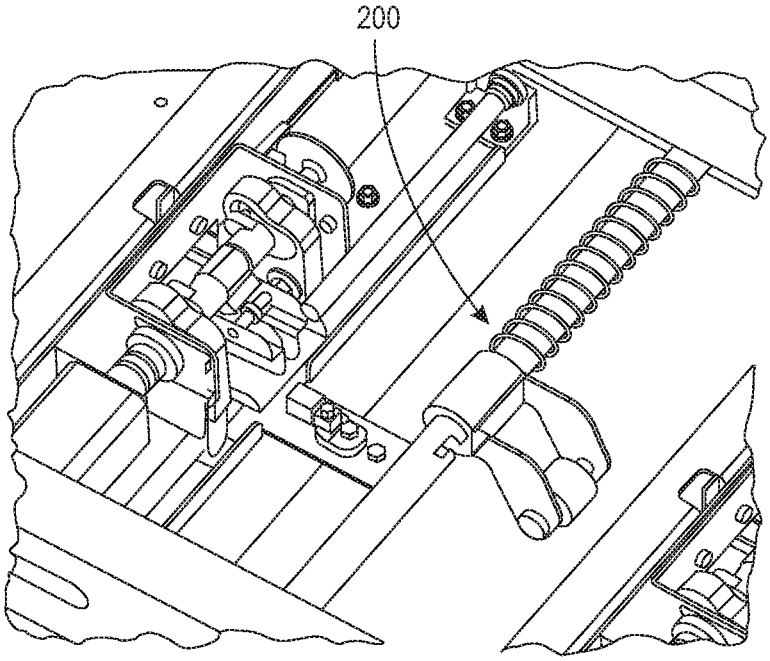

In an implementation, although the paper-clearance apparatus 200 includes the outer shaft 202, the inner shaft 206, the roller assembly 210, the spring 222 and the handle 226, the paper-clearance apparatus 200 is assembled in the printing medium path 102. For instance, as can be seen from FIG. 3A, the outer shaft 202 is first inserted from one of the two parallel external brackets 302 of a housing of the printer. Thereafter, as can be seen from FIG. 3B, the inner shaft 206 is assembled inside the outer shaft 202 and locked inside the guide path 204 using the guide pin 208, so as to assemble the roller assembly 210 over the assembly of the outer shaft 202 and the inner shaft 206 using the screws 216 in the manner as described above. Following this, the spring 222 and the handle are arranged (FIG. 3C). Then, the outer shaft 202 is mounted between the two parallel external brackets 302 of the housing of the printer and is arranged on an axis parallel to the axes of paper-transport rollers mounted in the printing medium path 102 of the multifunctional device or printer (FIG. 3D).

Figure 4A:
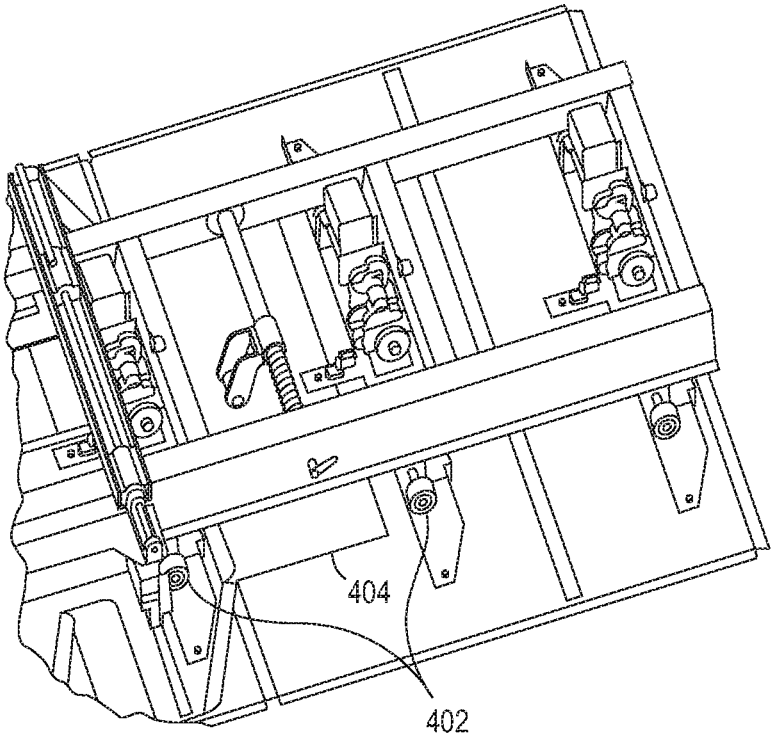
FIGS. 4A and 4B illustrate the exemplary views of the paper-clearance apparatus in the normal printing operation, in accordance with an embodiment of the present disclosure.
Figure 4B:
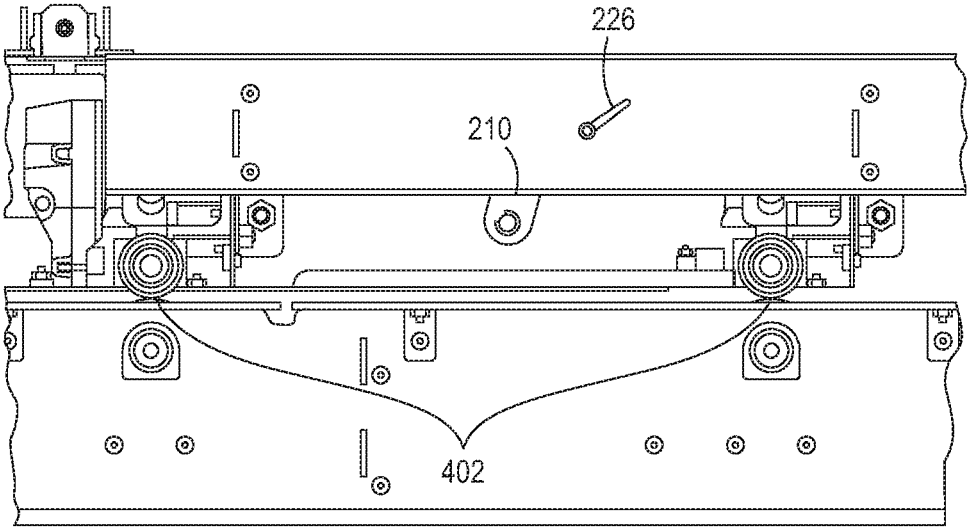

In the normal printing operation, as shown in FIGS. 4A and 4B, the paper transport rollers 402 are in engaged condition to move a paper 404 from one place to another place on the printing medium path 102, while the roller assembly 210 proposed herein is in lifted up condition (at a gap from the moving paper) and do not contact the moving paper 404.

Figure 5A:
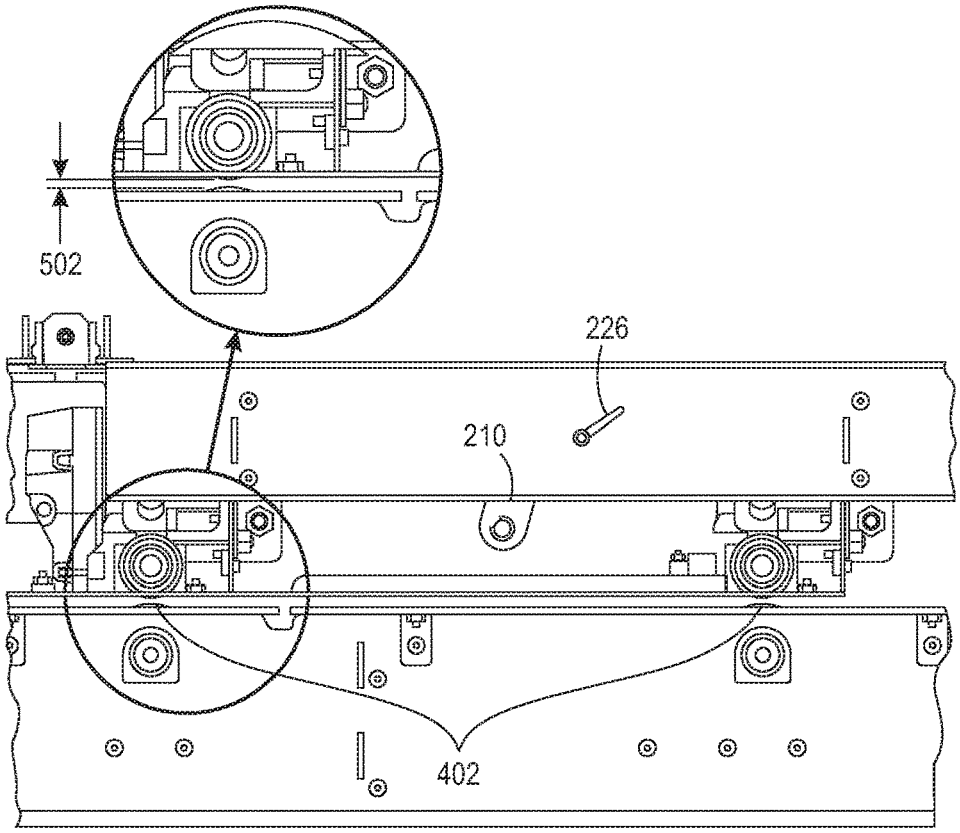
FIGS. 5A-5C illustrate the exemplary views of the paper-clearance apparatus in case of paper jam detection, in accordance with an embodiment of the present disclosure.
Figure 5B:
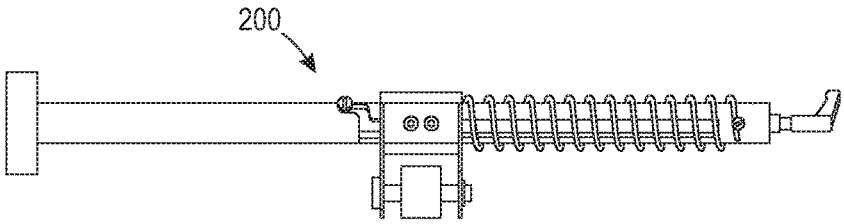
Figure 5C:
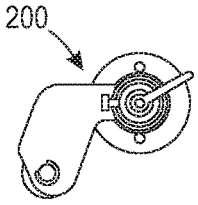

Now, as shown in FIGS. 5A-5C, in case the paper 404 jams in the printer, the paper transport rollers 402 get automatically disengaged and positioned at a gap 502 from the jammed paper 404, while the roller assembly 210 proposed herein remains in the lifted up condition and do not contact the jammed paper 404.

Figure 6A:
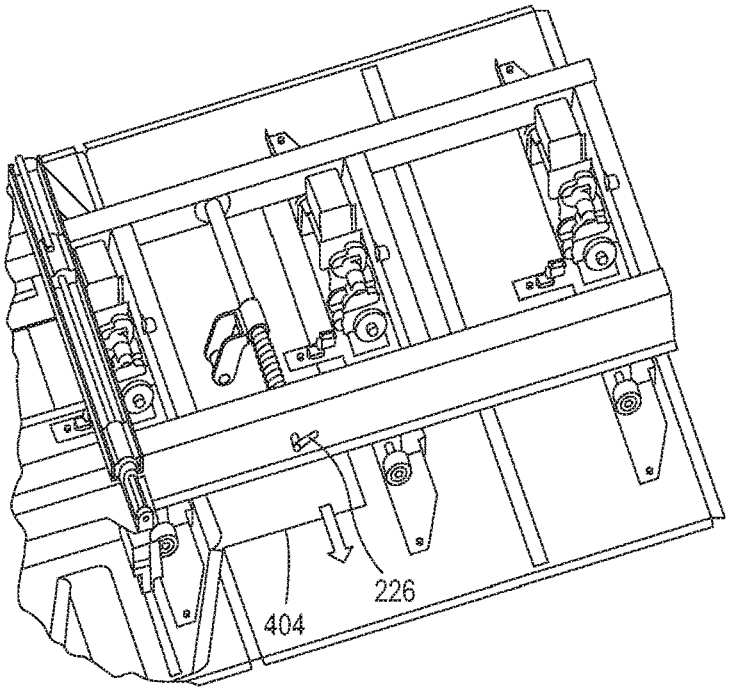
FIGS. 6A-6I illustrate various views of handling the paper-clearance apparatus for removing the jammed paper, illustrate the exemplary views of the paper-clearance apparatus in the normal printing operation, in accordance with an embodiment of the present disclosure.
Figure 6B:
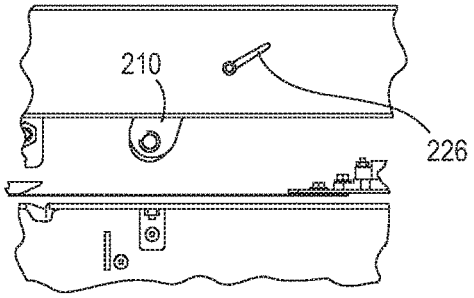
Figure 6C:
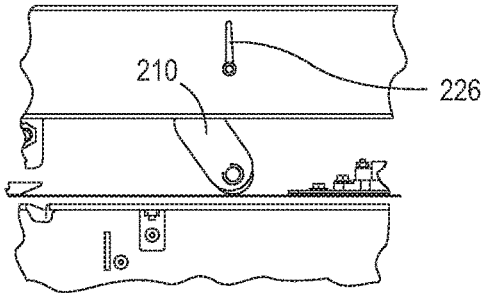
Figure 6D:
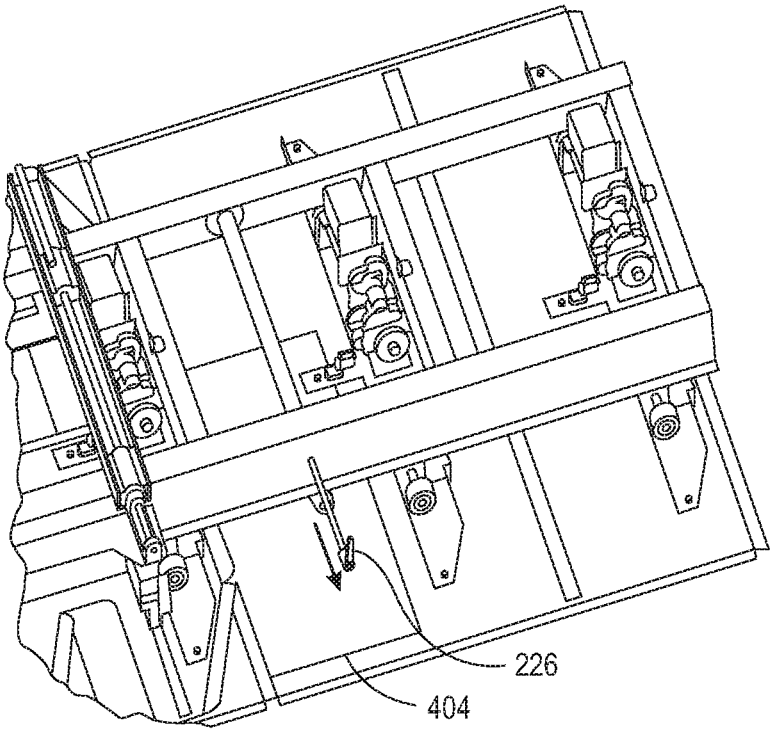
Figure 6E:
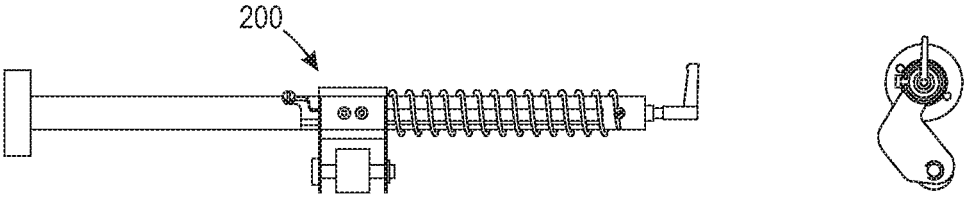
Figure 6F:
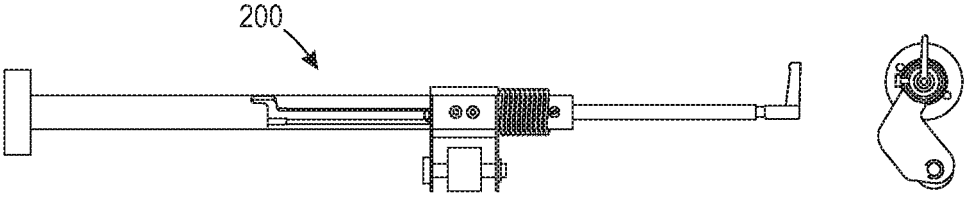

In accordance with an implementation of the present disclosure, once the paper 404 jams in the the printer, in the first step, a user may pull the handle 226 outside (FIG. 6A) up to, say, 10 mm away from the external wall of the housing of the printer. Then, in the second step, the user may rotate the handle 226 in the counterclockwise direction, as shown in FIGS. 6B and 6C, till the handle 226 is in an upright condition, so that inner shaft 206 is unlocked from the outer shaft 202 and the roller 218 connected with the inner shaft 206 rotates along with the jammed paper 404. While rotating the roller 218 along with the jammed paper 404, the roller 218 grips the paper 404. Following the rotation of the handle 226 and the roller 218, the user pulls the handle 226 further outside the external wall of the housing of the printer, as shown in FIGS. 6D-6F. When the handle 226 is pulled further, the inner shaft 206 along with roller assembly 210 mounted on the inner shaft 206 is moved in the guide path 204 of the outer shaft 202 against the compression force of the spring 222 to make the jammed paper 404 come outside the multifunctional device or the printer.

Thus, with the implementation of the paper-clearance apparatus 200 proposed herein, the user of the printer is able to remove the jammed paper easily from the printer.

Figure 6G:
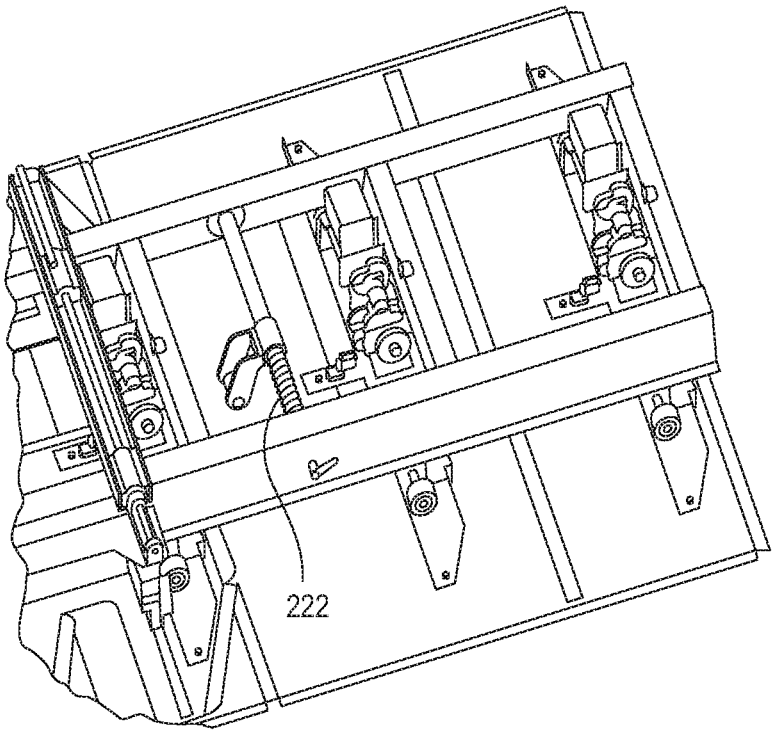
Figure 6H:
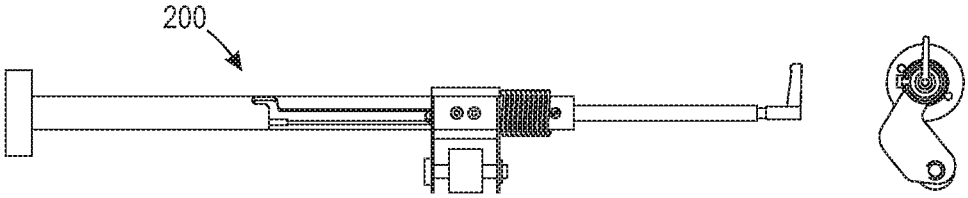
Figure 6I:
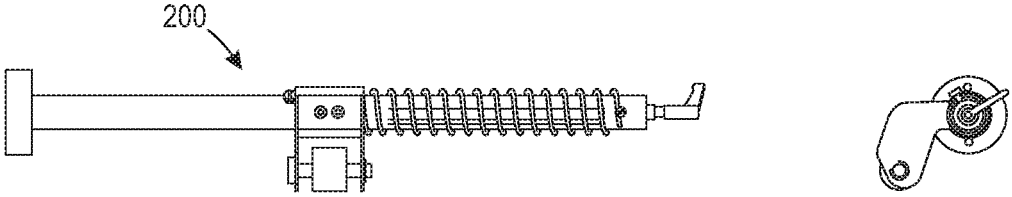

Finally, as shown in FIGS. 6G-6I, once the jammed paper 404 is removed, the roller assembly 210 or the roller 218 reaches its non-actuated original position due to the decompression force of the spring 222. Thereafter, the normal printing operation of the printer is resumed for further image processing.

The present disclosure proposes a new paper jam clearance mechanism to help the user to remove paper without personal injury. The disclosure may be implemented for any paper size printers such as wider paper sizes, for example, (19.7"×27.83"), other paper sizes such as 13"×19" without any limitation.

It can be appreciated by those skilled in the art that the use of phrase(s) "is," "are," "may," "can," "could," "will," "should," or the like, is for understanding various embodiments of the present disclosure and the phrases do not limit the disclosure or its implementation in any manner.

It is emphasized that the term "comprises" or "comprising" is used in this specification to specify the presence of stated features, integers, steps or components, but does not preclude the addition of one or more further features, integers, steps or components, or groups thereof.

The order in which the method is described is not intended to be construed as a limitation, and any number of the described method blocks can be combined in any order to implement the method or alternate methods. Additionally, individual blocks may be deleted from the method without departing from the spirit and scope of the subject matter described herein. Furthermore, the method can be implemented in any suitable hardware, software, firmware, or combination thereof. However, for ease of explanation, in the embodiments described below, the method may be considered to be implemented in the above-described system and/or the apparatus and/or any electronic device (not shown).

The above description does not provide specific details of the manufacture or design of the various components. Those of skill in the art are familiar with such details, and unless departures from those techniques are set out, techniques, known, related art or later developed designs and materials should be employed. Those in the art are capable of choosing suitable manufacturing and design details.

Note that throughout the following discussion, numerous references may be made regarding servers, services, engines, modules, interfaces, portals, platforms, or other systems formed from computing devices. It should be appreciated that the use of such terms is deemed to represent one or more computing devices having at least one processor configured to or programmed to execute software instructions stored on a computer-readable tangible, non-transitory medium or also referred to as a processor-readable medium. For example, a server can include one or more computers operating as a web server, database server, or another type of computer server in a manner to fulfill described roles, responsibilities, or functions. Within the context of this document, the disclosed devices or systems are also deemed to comprise computing devices having a processor and a non-transitory memory storing instructions executable by the processor that cause the device to control, manage, or otherwise manipulate the features of the devices or systems.

Some portions of the detailed description herein are presented in terms of algorithms and symbolic representations of operations on data bits performed by conventional computer components, including a central processing unit (CPU), memory storage devices for the CPU, and connected display devices. These algorithmic descriptions and representations are the means used by those skilled in the data processing arts to most effectively convey the substance of their work to others skilled in the art. An algorithm is generally perceived as a self-consistent sequence of steps leading to the desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be understood, however, that all of these and similar terms are to be associated with the appropriate physical quantities and are merely convenient labels applied to these quantities. Unless specifically stated otherwise, as apparent from the discussion herein, it is appreciated that throughout the description, discussions utilizing terms such as "engaging," or "rotating," or "inserting," or "pulling," or "transmitting," or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The exemplary embodiment also relates to an apparatus for performing the operations discussed herein. This apparatus may be specially constructed for the required purposes, or it may comprise a general-purpose computer selectively activated or reconfigured by a computer program stored in the computer. Such a computer program may be stored in a computer-readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, and each coupled to a computer system bus.

The algorithms and displays presented herein are not inherently related to any particular computer or other apparatus. Various general-purpose systems may be used with programs in accordance with the teachings herein, or it may prove convenient to construct more specialized apparatus to perform the methods described herein. The structure for a variety of these systems is apparent from the description above. In addition, the exemplary embodiment is not described with reference to any particular programming language. It will be appreciated that a variety of programming languages may be used to implement the teachings of the exemplary embodiment as described herein.

The methods illustrated throughout the specification may be implemented in a computer program product that may be executed on a computer. The computer program product may comprise a non-transitory computer-readable recording medium on which a control program is recorded, such as a disk, hard drive, or the like. Common forms of non-transitory computer-readable media include, for example, floppy disks, flexible disks, hard disks, magnetic tape, or any other magnetic storage medium, CD-ROM, DVD, or any other optical medium, a RAM, a PROM, an EPROM, a FLASH-EPROM, or other memory chip or cartridge, or any other tangible medium from which a computer can read and use.

Alternatively, the method may be implemented in transitory media, such as a transmittable carrier wave in which the control program is embodied as a data signal using transmission media, such as acoustic or light waves, such as those generated during radio wave and infrared data communications, and the like.

The terminology used herein is for the purpose of describing particular embodiments only and is not intended to be limiting of the disclosure. It will be appreciated that several of the above-disclosed and other features and functions, or alternatives thereof, may be combined into other systems or applications. Various presently unforeseen or unanticipated alternatives, modifications, variations, or improvements therein may subsequently be made by those skilled in the art without departing from the scope of the present disclosure as encompassed by the following claims.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A paper-clearance apparatus for removing jammed paper, the paper-clearance apparatus comprising:

an outer shaft mounted transversely above a printing medium path of a printer;

an inner shaft movably disposed inside the outer shaft;

a roller assembly including a sliding bush mounted over the outer shaft; and a handle connected inside the inner shaft from outside a printer housing, the handle being rotatable so that the roller connected with the inner shaft touches the jammed paper and rotates along with the jammed paper to grip the jammed paper, and the handle being pullable away from the printer housing so as to pull out the jammed paper beneath the printer housing.

2. The paper-clearance apparatus of claim 1, wherein the outer shaft is having the length equal to the width of the printing medium path of a printer, the outer shaft having an open longitudinal guide path, wherein the inner shaft is having half the length of the outer shaft, and wherein the inner shaft is assembled inside the outer shaft and locked inside the guide path using a guide pin.

3. The paper-clearance apparatus of claim 2, wherein the longitudinal guide path is a longitudinal cutout on the external surface of the outer shaft.

4. The paper-clearance apparatus of claim 2, wherein the longitudinal guide path is formed from the center of the outer shaft up to one of the external end of the outer shaft.

5. The paper-clearance apparatus of claim 2, wherein the guide pin is fixed on the inner shaft in such a way that the guide pin gets locked at the internal end of the guide path.

6. The paper-clearance apparatus of claim 2, wherein the roller assembly includes a mounting bracket which is locked at its head portion with the sliding bush on an internal end of the inner shaft, and wherein the roller assembly further includes a roller mounted in between legs of the mounting bracket using fasteners, wherein in normal printing operation, the roller assembly is positioned in a lifted up condition at a gap from a moving paper.

7. The paper-clearance apparatus of claim 6, wherein the fasteners used for mounting of the roller includes a pin and clip assembly.

8. The paper-clearance apparatus of claim 6, further comprising a spring arranged over the outer shaft, wherein the spring is mounted between the sliding bush and a screw fixed on an external end of the outer shaft.

9. The paper-clearance apparatus of claim 8, wherein when the handle is pulled away from the printer housing, the inner shaft along with roller assembly mounted on the inner shaft is moved in the guide path of the outer shaft against the compression force of the spring.

10. The paper-clearance apparatus of claim 8, wherein the spring is arranged over the outer shaft in the region of the guide path.

11. The paper-clearance apparatus of claim 8, wherein after removal of the jammed paper, the inner shaft along with roller assembly retains its original position using decompression force of the spring.

12. The paper-clearance apparatus of claim 1, wherein the handle is rotatable in a first direction to grip and pull out the jammed paper.

13. The paper-clearance apparatus of claim 12, wherein to remove the jammed paper from the printer, the handle is to be pulled outside for about 10 mm before being rotated in the first direction.

14. The paper-clearance apparatus of claim 12, wherein the handle is rotatable in a second direction which is being opposite to the first direction, so as to unlock the inner shaft from the outer shaft.

15. A printer, comprising:

two parallel external brackets of a printer housing;

an outer shaft mounted between the two parallel external brackets and transversely above a printing medium path of the printer;

an inner shaft movably disposed inside the outer shaft;

a roller assembly including a sliding bush mounted over the outer shaft; and a handle connected inside the inner shaft from outside the printer housing, the handle being rotatable so that the roller connected with the inner shaft touches the jammed paper and rotates along with the jammed paper to grip the jammed paper, and the handle being pullable away from the printer housing so as to pull out the jammed paper beneath the printer housing.

16. The printer of claim 15, wherein the outer shaft is having the length equal to the width of a printing medium path of the printer, the outer shaft having an open longitudinal guide path, wherein the inner shaft is having half the length of the outer shaft, and wherein the inner shaft is assembled inside the outer shaft and locked inside the guide path using a guide pin.

17. The printer of claim 16, wherein the longitudinal guide path is a longitudinal cutout on the external surface of the outer shaft.

18. The printer of claim 16, wherein the longitudinal guide path is formed from the center of the outer shaft up to one of the external end of the outer shaft.

19. The printer of claim 16, wherein the guide pin is fixed on the inner shaft in such a way that the guide pin gets locked at the internal end of the guide path.

20. The printer of claim 16, wherein the roller assembly includes a mounting bracket which is locked at its head portion with the sliding bush on an internal end of the inner shaft, and wherein the roller assembly further includes a roller mounted in between legs of the mounting bracket using fasteners, wherein in normal printing operation, the roller assembly is positioned in a lifted up condition at a gap from a moving paper.

21. The printer of claim 20, wherein the fasteners used for mounting of the roller includes a pin and clip assembly.

22. The printer of claim 20, further comprising a spring arranged over the outer shaft, wherein the spring is mounted between the sliding bush and a screw fixed on an external end of the outer shaft.

23. The printer of claim 22, wherein when the handle is pulled away from the printer housing, the inner shaft along with roller assembly mounted on the inner shaft is moved in the guide path of the outer shaft against the compression force of the spring.

24. The printer of claim 22, wherein the spring is arranged over the outer shaft in the region of the guide path.

25. The printer of claim 22, wherein after removal of the jammed paper, the inner shaft along with roller assembly retains its original position using decompression force of the spring.

26. The printer of claim 15, wherein the handle is rotatable in a first direction to grip and pull out the jammed paper.

27. The printer of claim 26, wherein to remove the jammed paper from the printer, the handle is to be pulled outside for about 10 mm before being rotated in the first direction.

28. The printer of claim 26, wherein the handle is rotatable in a second direction which is being opposite to the first direction, so as to unlock the inner shaft from the outer shaft.

* * * * *